US007627270B2

(12) United States Patent
Fujita

(10) Patent No.: US 7,627,270 B2
(45) Date of Patent: Dec. 1, 2009

(54) IMAGE FORMING APPARATUS THAT EFFECTIVELY CHARGES A LATENT IMAGE CARRIER

(75) Inventor: Tetsumaru Fujita, Nishinomiya (JP)

(73) Assignee: Ricoh Co., Ltd., Tokyo (JP)

( * ) Notice: Subject to any disclaimer, the term of this patent is extended or adjusted under 35 U.S.C. 154(b) by 109 days.

(21) Appl. No.: 11/625,669

(22) Filed: Jan. 22, 2007

(65) Prior Publication Data

US 2007/0172259 A1 Jul. 26, 2007

(30) Foreign Application Priority Data

Jan. 20, 2006 (JP) ..... 2006-012671

(51) Int. Cl.
*G03G 15/02* (2006.01)

(52) U.S. Cl. ..... 399/175

(58) Field of Classification Search ..... 399/175, 399/176, 115

See application file for complete search history.

(56) References Cited

U.S. PATENT DOCUMENTS

| | | | | |
|---|---|---|---|---|
| 5,576,807 | A * | 11/1996 | Osawa et al. | 399/175 |
| 5,708,932 | A * | 1/1998 | Yano et al. | 399/159 |
| 2003/0039494 | A1* | 2/2003 | Shakuto et al. | 399/357 |
| 2005/0074264 | A1* | 4/2005 | Amemiya et al. | 399/346 |
| 2005/0129428 | A1* | 6/2005 | Nagatomo et al. | 399/175 |

FOREIGN PATENT DOCUMENTS

| | | |
|---|---|---|
| JP | 08-185011 | 7/1996 |
| JP | 2000-066481 | 3/2000 |
| JP | 2002-055509 | 2/2002 |
| JP | 2004-053942 | 2/2004 |
| JP | 2005-128111 | 5/2005 |
| JP | 2005-242007 | 9/2005 |

OTHER PUBLICATIONS

U.S. Appl. No. 11/954,309, filed Dec. 12, 2007, Sakagawa et al.
U.S. Appl. No. 11/954,342, filed Dec. 12, 2007, Sakagawa et al.
U.S. Appl. No. 11/956,901, filed Dec. 14, 2007, Fujita et al.
U.S. Appl. No. 12/020,089, filed Jan. 25, 2008, Sakagawa et al.
U.S. Appl. No. 12/023,544, filed Jan. 31, 2008, Sakagawa et al.
U.S. Appl. No. 12/021,630, filed Jan. 29, 2008, Fujita et al.

(Continued)

*Primary Examiner*—Quana M Grainger
(74) *Attorney, Agent, or Firm*—Oblon, Spivak, McClelland, Maier & Neustadt, L.L.P.

(57) ABSTRACT

A charging device for applying a voltage to a latent image carrier of an image forming apparatus includes a brush roller, a voltage applying mechanism, and a driving mechanism. The brush roller includes a shaft and a brush. The brush has an oblique brush amount, and is disposed on an outer surface of the shaft while being disposed to a surface of the latent image carrier such that the brush roller is abutted with a brush contact amount. This brush is configured to uniformly charge the surface of the latent image carrier. The voltage applying mechanism is configured to apply a charging voltage to the brush roller. The driving mechanism is configured to drive the brush roller at a predetermined rotation number to satisfy a relationship Z>150−50A, where Z is a rotation number (rpm) of the brush roller, and A is the oblique brush amount (mm).

10 Claims, 2 Drawing Sheets

OTHER PUBLICATIONS

U.S. Appl. No. 12/050,529, filed Mar. 18, 2008, Sakagawa et al.
U.S. Appl. No. 11/837,155, filed Aug. 10, 2007, Fujita et al.
U.S. Appl. No. 11/849,686, filed Sep. 4, 2007, Fujita et al.
U.S. Appl. No. 11/855,687, filed Sep. 14, 2007, Fujita et al.
U.S. Appl. No. 12/178,108, filed Jul. 23, 2008, Fujita et al.
U.S. Appl. No. 12/187,021, filed Aug. 6, 2008, Shono et al.

* cited by examiner

IMAGE FORMING APPARATUS THAT EFFECTIVELY CHARGES A LATENT IMAGE CARRIER

CROSS-REFERENCE TO RELATED APPLICATION

This patent application is based on and claims priority from Japanese patent application, No. 2006-012671 filed on Jan. 20, 2006 in the Japan Patent Office, the entire contents of which are incorporated by reference herein.

BACKGROUND

1. Field of Invention

Exemplary aspects of the present invention relate to an image forming apparatus, and more particularly to an image forming apparatus employing a charging device having a brush roller to uniformly charge a surface of a latent image carrier.

2. Description of the Related Art

In general, a related art image forming apparatus has employed a non-contact charging device including a scorotron charger to charge a surface of a latent image carrier (referred to as a photoconductor) without contacting the photoconductor surface. However, the non-contact charging device generates a discharge product such as an ozone and/or a nitrogen oxide (NOx). A contact charging device, on the other hand, charges the photoconductor surface by contacting the photoconductor surface while reducing an occurrence of generating the discharge product. Accordingly, the contact charging device has had increased attention.

The contact charging device includes contact charging members, for example, a charging roller, a charging film, and a charging brush. The charging roller may have a flat surface, and the charging brush may be fixed or rotatable. The contact charging members have been known to execute a charging process by abutting on the photoconductor surface. When the contact charging device is employed, the photoconductor surface may have a substance, for example, a toner, adhered thereon. This substance may adhere to the contact charging members. Thereby, the contact charging device may have a reduced charging capability over time caused by the substance.

One example uses a rotatable charging brush for the contact charging device. By using the rotatable charging brush, a likelihood of reduced charging capability may be lower compared to other contact charging members such as the charging roller and the charging film.

SUMMARY

According to an aspect of the invention, a charging device for applying a voltage to a latent image carrier of an image forming apparatus includes a brush roller, a voltage applying mechanism, and a driving mechanism. The brush roller includes a cylindrical shaft and a brush. This brush has an oblique brush amount and is disposed on an outer circumference surface of the cylindrical shaft. The brush is disposed with respect to a surface of the latent image carrier in such a manner that the brush roller is abutted with a suitable brush contact amount. This brush is configured to uniformly charge the surface of the latent image carrier during a charging process. The voltage applying mechanism is configured to apply a charging voltage to the brush roller. The driving mechanism is configured to rotationally drive the brush roller at a predetermined rotation number so as to satisfy a relationship $Z>150-50\ A$, where Z is a value of a rotation number (rpm) of the brush roller, and A is a value of the oblique brush amount (mm).

According to another aspect of the invention, a charging device for applying a voltage to a latent image carrier of an image forming apparatus includes a brush roller, a voltage applying mechanism, and a driving mechanism. The brush roller includes a cylindrical shaft and a brush. The brush has an oblique brush amount and a plurality of flat brush hairs on an outer circumference surface of the cylindrical shaft. The brush is disposed with respect to a surface of the latent image carrier in such a manner that the brush roller is abutted with a suitable brush contact amount. This brush is configured to uniformly charge the surface of the latent image carrier during a charging process. The voltage applying mechanism is configured to apply a charging voltage to the brush roller. The driving mechanism is configured to rotationally drive the brush roller at a predetermined rotation number so as to satisfy a relationship $Z>150-50\ A$, where Z is a value of a rotation number (rpm) of the brush roller, and A is the oblique brush amount (mm).

According to another aspect of the invention, an image forming apparatus includes the charging device, and is configured to form a toner image by uniformly charging the surface of the latent image carrier, forming a latent image on the surface of the latent image carrier, adhering a toner onto the latent image, and transferring the toner image onto a recording member.

BRIEF DESCRIPTION OF THE DRAWINGS

A more complete appreciation of the exemplary aspects of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
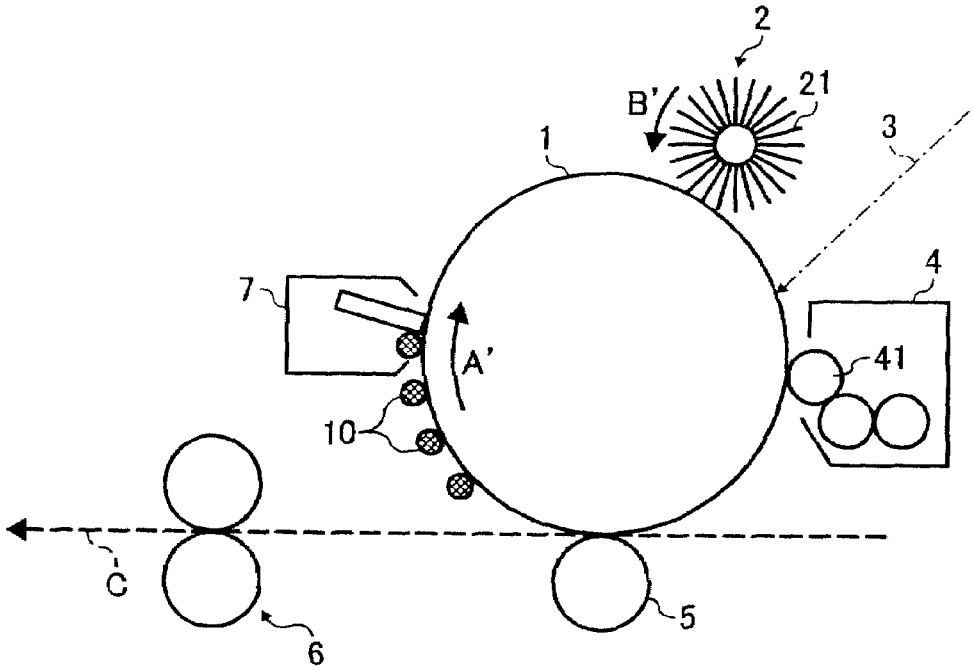
FIG. 1 is a schematic diagram partially illustrating a configuration of an image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to exemplary embodiments of the present invention is described.

Referring to FIG. 1, the image forming apparatus has an electrophotographic method capable of forming a monochrome image, and includes image forming elements such as a photoconductor 1, a charging device 2, a development device 4, a transfer device 5, a fixing device 6, a cleaning device 7, and an exposure device (not shown). The charging device 2 includes a brush roller 21. The development device 4 includes development roller 41.

The photoconductor 1 as a latent image carrier forms an electrostatic latent image thereon by a laser beam 3 shown with a dashed line. The charging device 2 uniformly charges a surface of the photoconductor 1. The development device 4 develops the electrostatic latent image on the photoconductor 1 with a charging toner. The transfer device 5 transfers a toner image onto a transfer sheet as a recoding member from the photoconductor 1. The fixing device 6 fixes the toner image on the transfer sheet. The cleaning device 7 removes remaining toner 10 from the photoconductor 1 after the toner image is transferred. The exposure device emits the laser beam 3 that is modulated based on image information so that the photoconductor 1 is irradiated. The brush roller 21 included in the charging device 2 is a roller with a brush. The brush includes a large number of brush hairs. The development roller 41 acts as a developer carrying member to carry the charging toner. The transfer sheet is fed from a sheet conveyance device (not shown), and is conveyed along a conveyance path C shown with another dashed line.

As shown in FIG. 1, the photoconductor 1 sequentially includes the charging device 2, the exposure device, the development device 4, the transfer device 5, and the cleaning device 7 in a vicinity thereof.

The image forming apparatus includes a plurality of image forming elements, for example, the photoconductor 1, the charging device 2, and the development device 4. At least two of these image forming elements may be integrally configured as a unit, and detachably installed in the image forming apparatus.

According to this exemplary embodiment, the photoconductor 1, the brush roller 21, the development device 4, and the cleaning device 7 integrally support one another, and are formed as a process cartridge that is detachably installed in the image forming apparatus. The description of the cartridge in the exemplary embodiment is illustrative, and is not to be considered limiting. The process cartridge may be configured to integrally support at least the photoconductor 1 and the brush roller 21.

The image forming apparatus of FIG. 1 forms the toner image on the transfer sheet. A detailed description of forming the toner image on the transfer sheet will be given as follows.

The surface of the photoconductor 1 is rotationally driven in a direction A' indicated with an arrow so as to be uniformly charged by the charging device 2. A detailed description of the charging device 2 will be given in FIG. 2. The surface of the photoconductor 1 charged by the charging device 2 is irradiated with the laser beam 3 emitted from the exposure device. Here, the laser beam 3 scans in an axial direction of the photoconductor 1. Thereby, the photoconductor 1 forms the electrostatic latent image thereon. The electrostatic latent image formed on the photoconductor 1 is developed by the development device 4 in a development region with the charging toner on the development roller 41 so as to form the toner image. The development region is disposed opposite to the development roller 41. The transfer sheet is fed and conveyed to the sheet conveyance path C by the sheet conveyance device, and is delivered to a transfer region by a registration roller (not shown) at an appropriate timing. The transfer region is a region formed between the photoconductor 1 and the transfer device 5. The transfer device 5 applies an electric charge that has a reverse polarity from the toner image on the photoconductor 1 to the transfer sheet so that the toner image is transferred from the photoconductor 1 onto the transfer sheet. The transfer sheet is separated from the photoconductor 1, and is conveyed to the fixing device 6 in which the toner image is fixed. The transfer sheet with the fixed toner image is ejected from the image forming apparatus. When the toner image is transferred from the photoconductor 1 onto the transfer sheet by the transfer device 5, the cleaning device 7 removes the remaining toner from the surface of the photoconductor 1.

The photoconductor 1 of the exemplary embodiment is configured to be a pipe such as an aluminum pipe on which an organic photoconductor or an inorganic photoconductor is applied to form a photoconductor layer. However, the photoconductor 1 may be configured to be another form. The image forming apparatus of this exemplary embodiment employs the photoconductor 1 that is uniformly charged to a negative polarity. However, the image forming apparatus may employ a photoconductor that is uniformly charged to a positive polarity in corresponding to a relationship with a polarity of the charging toner, for example.

Figure 2:
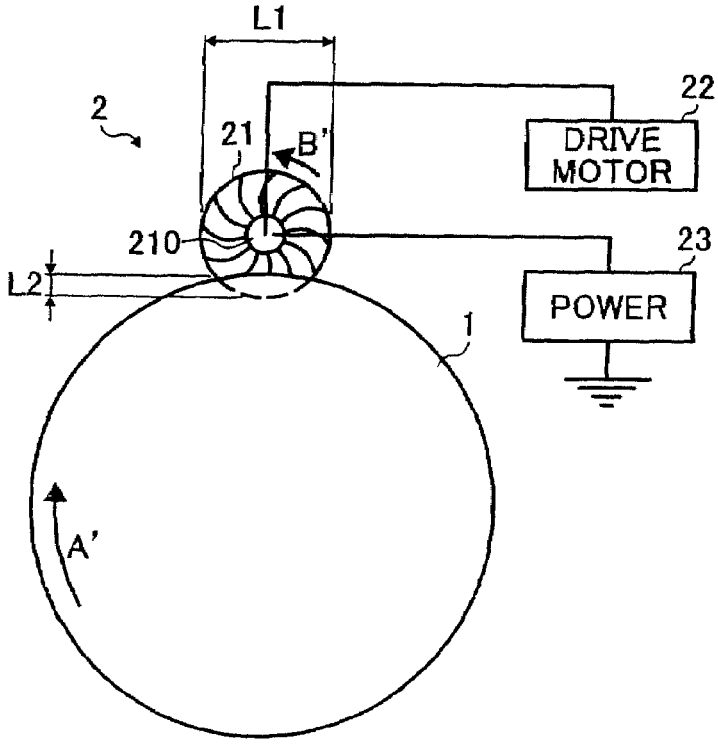
FIG. 2 is a schematic diagram illustrating a photoconductor and a development device included in the image forming apparatus of FIG. 1.

Referring to FIG. 2, the photoconductor 1 and the charging device 2 included in FIG. 1 are schematically enlarged. The charging device 2 includes the brush roller 21, a shaft 210, a drive motor 22, and a power source 23. The brush roller 21 includes the brush on a surface thereof. The shaft 210 is a shaft of the brush roller 21, and is in a circular shape. The drive motor 22 as a drive mechanism drives the brush roller 21 to rotate. The power source 23 as a voltage applying mechanism applies a suitable voltage to the brush roller 21.

The brush roller 21 contacts the surface of the photoconductor 1 so that charging device 2 uniformly charges the surface of the photoconductor 1. As shown in FIG. 2, the brush roller 21 has an outside diameter L1, and a brush contact amount L2. The brush contact amount L2 indicates a distance between two points (described later) on a virtual line between a rotation center of the photoconductor 1 and a rotation center of the brush roller 21. The two points indicate a point where a distal end of the brush is positioned when the photoconductor is not disposed, and a point where the surface of the photoconductor is positioned when the photoconductor 1 is disposed.

The brush roller 21 of this exemplary embodiment is configured to include a flat plate brush material that has the brush including the large number of brush hairs with a thickness of 2 deniers or below, a tensile strength of 78.4 MPa (800 kgf/$cm^2$) or below, and a length of 2.5 mm or above. This flat plate brush material is wound around the shaft 210 in a roll shape in such a manner that the brush roller 21 has a volume resistivity of $10^8$ (Ω·cm), and a density of 200 (kF/$inch^2$). The brush hairs may be nylon and acrylic fiber, for example. The brush roller 21 is disposed in such a manner that the brush contact amount L2 becomes 0.5 mm. The brush roller 21 is rotated in a movement direction B' by the drive motor 22 with respect to a movement direction A' of the surface of the photoconductor 1. Here, the power source 23 applies a direct current voltage of −1.2 kV to the brush roller 21. The photoconductor 1 of this exemplary embodiment is an organic photoconductor. The photoconductor 1 has an outside diameter of 24 mm and the photoconductor layer with a thickness of 25 μm, and is rotated in such a manner that a movement speed of the surface thereof is 60 mm/s.

According to this exemplary embodiment, the brush roller 21 has an outside diameter of 12 mm or below. The brush roller 21 has an oblique brush hair amount A (mm) and a rotation number Z (rpm). The rotation number Z represents a rotation number (rpm) of the brush roller 21 during a charging process in which the photoconductor surface is uniformly charged by the charging device 2. The oblique brush hair amount A and the rotation number Z are arranged to satisfy a relationship, Z>150−50 A.

When the brush roller 21 is stopped and left for a certain time period in a state that the brush roller 21 is contacted to the surface of the photoconductor 1, for example, with a certain value of the brush contact amount L2, the brush hairs may become skewed and curled. However, when the brush roller 21 is rerotated, the skewed and curled brush hairs are restored by a resiliency thereof and a centrifugal force applied thereto. Thereby, the charging device 2 having the brush roller 21 with the outside diameter of 12 mm or below may reduce an error occurrence of charging the surface of the photoconductor 1 appropriately.

An example experiment (referred to as an example experiment 1) was conducted based on conditions that were similar to the brush roller 21 of the exemplary embodiment stated above. A detailed description of the example experiment 1 will be given.

A plurality of the brush rollers 21 were used for the example experiment 1, and were numbered in 21*a* through 21*d* shown in TABLE 1. Each of the plurality of the brush rollers 21*a* through 21*d* had substantially similar conditions to the brush roller 21 of the exemplary embodiment. Accordingly, the brush rollers 21*a* through 21*d* had the following conditions. The volume resistivity was approximately $10^8$ (Ω cm). The flat plate brush material had the brush including the brush hairs with the thickness of 2 deniers. The brush hairs had the density of 200 kF. Each of the brush rollers 21*a* through 21*d* was wound around the shaft 210 in the roll shape. Each of the brush rollers 21*a* through 21*d* was rotationally driven in a following movement direction with respect to the movement direction of the surface of the photoconductor 1. The direct current voltage of −1.2 kV was applied to each of the brush rollers 21*a* through 21*d*. The photoconductor 1 had the movement speed (may be referred to as a process speed) of the surface thereof at 60 mm/s. The brush contact amount L2 was 0.5 mm.

However, each of the plurality of the brush rollers 21*a* through 21*d* for the example experiment 1 had different properties such as the outside diameter, the shaft diameter, the brush length, and the pile length. In other words, the plurality of the brush rollers 21*a* through 21*d* had substantially similar conditions while having the different properties.

According to the example experiment 1, the plurality of the brush rollers 21*a* through 21*d* in the image forming apparatus were left for one week in an environment in which a temperature was 40 degrees Celsius and a humidity was 90%. When the one week passed, images of 1×1 and 2×2 were formed in solid half-tone, and were evaluated based on visual comparisons of an occurrence of a black belt therein. The image of 1×1 refers to an image having a 1 dot of image area and a 1 dot of non-image area alternately. The image of 2×2 refers to an image having 2 dots of image area and 2 dots of non-image area alternately. The black belt refers to a black line extending on the image perpendicular to a transfer sheet conveyance direction. The black belt on the image of 1×1 has a higher visibility than that of 2×2. The example experiment 1 was evaluated based on the visual comparisons between the image of 1×1 and an evaluation image, and between the image of and 2×2 and the evaluation image. The evaluation image refers to an image used for the evaluation. This evaluation image included the black belt of which a likelihood of an occurrence was practicable in a permissive limit. The images were visually compared and evaluated as follows.

Class I: When the 1×1 image provided a lower visibility of the black belt than that of the evaluation image, the 1×1 image was evaluated as Class I.

Class II: When the 2×2 image provided a lower visibility of the black belt than that of the evaluation image, the 2×2 image was evaluated as Class II.

Class III: When the 2×2 provided a visibility of the black belt that was at least substantially the same as that of the evaluation image, the 2×2 image was evaluated as Class III.

Class IV: When the 2×2 image provided a higher visibility of the black belt than that of the evaluation image, the 2×2 image was evaluated as Class IV.

The plurality of the brush rollers 21*a* through 21*d* with the different properties were used and evaluated for the example experiment 1. For example, the different properties included the outside diameter (OD) of the brush roller 21, the shaft diameter (SD), the brush length (BL), and the pile length (PL), the oblique brush hair amount (A), and the rotation number (Z). The brush length refers to a length of the brush with a ground fabric and a glue, for example. The pile length refers to a length of a yarn that forms the brush. Evaluation results will be shown in an image evaluation (EV) column in TABLE 1.

TABLE 1

| # | OD (mm) | SD (mm) | BL (mm) | PL (mm) | A (mm) | Z (rpm) | EV |
|---|---|---|---|---|---|---|---|
| 21a | 13 | 5 | 4 | 4 | 0 | 125 | II |
| 21b | 12 | 6 | 3 | 3 | 0 | 125 | IV |
| 21c | 12 | 8 | 2 | 2 | 0 | 125 | IV |
| 21d | 11 | 6 | 2.5 | 2.5 | 0 | 125 | IV |

According to the evaluation results shown in TABLE 1, when the outside diameter (OD) of the brush roller 21 was 13 mm or above, for example, the brush roller 21*a*, the image was evaluated as Class II. On the other hand, when the outside diameters of the brush rollers 21 were 12 mm or below, for example, the brush rollers 21*b*, 21*c*, and 21*d*, the images were evaluated as Class IV. Thereby, the evaluation results were varied depending on whether or not the brush roller 21 had the outside diameter of 12 mm. Since each of the brush rollers 21*a* through 21*d* was left for the one week while the brush thereof was contacting on the surface of the photoconductor, the brush hairs became skewed and curled. After the one week, each of the brush rollers 21*a* through 21*d* contacted on the photoconductor surface in a contact state that the brush had the skewed and curled brush hairs when the image forming apparatus provided an image forming process. On the other hand, before the one week, each of the brush rollers 21*a* through 21*d* contacted on the photoconductor surface in a contact state that the brush had substantially no skewed and curled brush hair. Thereby, the contact states of before and after the one week were varied. The skewed and curled brush hairs increased a likelihood of an error occurrence of contacting the surface of the photoconductor, and the surface of the photoconductor reduced an occurrence of being charged appropriately. Thereby, the black belt was generated by adhering a toner on the surface of the photoconductor.

When a brush roller 21 having the outside diameter of 13 mm or above is used, the brush hairs can be considered to have a larger centrifugal force applied thereto than that of 13 mm or below. After the one week, when the brush roller 21 is rerotated, the skewed and curled brush hairs may be restored by the resiliency thereof and the centrifugal applied thereto. Thereby, the contact state between the brush hairs and the photoconductor surface may be restored, and may become at least substantially similar to the contact state of before the one week. In other words, when the brush roller 21 having the outside diameter of 13 mm or above is used, the photoconductor surface may be appropriately charged by the brush hairs so that an occurrence of providing the black belt may be reduced. Therefore, the image formed by using the brush roller 21*a* having the outside diameter of 13 was evaluated as Class II.

On the other hand, when the brush rollers 21*b*, 21*c*, and 21*d* having the outside diameter of 12 mm or below were used, the brush hairs had smaller centrifugal forces applied thereto than that of 13 mm. After the one week, when each of the brush rollers 21*b*, 21*c*, and 21*d* was rerotated, the contact state between the skewed and curled brush hairs and the photoconductor surface was slightly recovered. This slightly recovered contact state reduced an occurrence of restoring thereof to become at least substantially similar to the contact state of before the one week. In other words, when the brush rollers 21*b*, 21*c*, and 21*d* having the outside diameter of 12 mm or below were used, the photoconductor surface was inappropriately charged by the brush hairs. Thereby, an occurrence of providing the black belt was increased. The images formed by using the brush rollers 21*b*, 21*c*, and 21*d* having the outside diameter of 12 or below were evaluated as Class IV.

Another example experiment (referred to as an example experiment 2) was conducted. A detailed description of the example experiment 2 will be given.

The example experiment 2 was similar to the example experiment 1, except for, an oblique brush ratio (AR). The oblique brush ratio is a percentage of the oblique brush hair amount. As the properties, abbreviations, evaluation Classes used for the example experiment 2 were corresponding to those of the example experiment 1. A plurality of the brush rollers 21 having the outside diameter of 11 mm were used for the example experiment 2, and were numbered in 21*e* through 21*k*. The oblique brush hair amount, the pile length, the oblique brush ratio, and the rotation number were varied for the evaluations. Evaluation results of the example experiment 2 will be shown in TABLE 2.

TABLE 2

| # | OD (MM) | SD (mm) | BL (mm) | PL (mm) | A (mm) | AR (%) | Z (rpm) | EV |
|---|---|---|---|---|---|---|---|---|
| 21e | 11 | 5 | 3 | 3 | 0 | 0 | 150 | IV |
| 21f | 11 | 5 | 3 | 3 | 0 | 0 | 200 | II |
| 21g | 11 | 5 | 3 | 3.5 | 0.5 | 14 | 200 | II |
| 21h | 11 | 5 | 3 | 4 | 1 | 25 | 150 | I |
| 21i | 11 | 5 | 3 | 4 | 1 | 25 | 100 | IV |
| 21j | 11 | 5 | 3 | 4.5 | 1.5 | 33 | 100 | II |
| 21k | 11 | 5 | 3 | 5 | 2 | 40 | 100 | I |

As shown in TABLE 2, the brush rollers 21*e* and 21*f* had straight brush hairs. In other words, the brush hairs of the brush rollers 21*e* and 21*f* were not oblique at the beginning. However, the brush hairs of the brush rollers 21*e* and 21*f* were skewed and curled after the one week. The image formed by using by the brush roller 21*e* was evaluated as Class IV while the image formed by using the brush roller 21*f* was evaluated as Class II. The rotation number Z for the brush roller 21*f* was increased to 200 rpm so that the centrifugal force applied to the brush roller 21*f* was increased compared to the brush roller 21*e*. In this way, the brush roller 21*f* having the skewed and curled hairs was restored, and became at least substantially similar to the contact state of before the one week. Thereby, the photoconductor surface was considered to be appropriately charged by using the brush roller 21*f*.

The brush rollers 21*e* and 21*h* had the rotation number Z of 150 rpm. However, the image formed by using the brush roller 21*e* was evaluated as Class IV while the image formed by using the brush roller 21*h* was evaluated as Class I. The brush roller 21*h* had the oblique brush hairs at the beginning, and contacted on the photoconductor surface in a state that the oblique brush hairs were evenly curled. As the brush roller 21*h* had the oblique brush hairs at the beginning, the brush hairs of the brush roller 21*h* reduced a tendency thereof to skew and curl when the brush roller 21*h* was left for the one week. The brush roller 21*h* was capable of restoring the brush hairs thereof with a relatively low centrifugal force, and became at least substantially similar to the contact state of before the one week. Thereby, the photoconductor surface was considered to be appropriately charged by using the brush roller 21*h*.

According to the example experiment 2, when the oblique brush hair amount A and the rotation number Z satisfied the relationship of $Z>150-50\,A$, the images were at least evaluated as Class II.

When the brush roller 21 has the pile length of 2 mm or below, a white spot may be generated on the image. This white spot may deteriorate the image. Thereby, the pile length should be at least 2.5 mm.

Another example experiment (referred to as an example experiment 3) was conducted by using a plurality of the brush rollers 21. The plurality of the brush rollers 21 were numbered 21*l* through 21*p*. A detailed description of the example experiment 3 will be given.

The example experiment 3 was similar to the example experiment 1, except for, the oblique brush ratio (AR), and a brush thickness (BT). The properties, abbreviations, evaluation Classes used for the example experiment 3 were corresponding to those of the example experiment 1.

The plurality of the brush rollers 21*l* through 21*p* having the outside diameter of 11 mm and the oblique brush amount of 1 mm were rotated at the rotation number Z of 200 rpm for the example experiment 3. The oblique brush ratio of each of the brush rollers 21*l* through 21*p* was varied for the evaluation. Evaluation results of the example experiment 3 will be shown in TABLE 3.

TABLE 3

| # | BT (D) | OD (mm) | SD (mm) | BL (mm) | PL (mm) | A (mm) | AR (mm) | Z (rpm) | EV |
|---|---|---|---|---|---|---|---|---|---|
| 211 | 2 | 11 | 4 | 3.5 | 4.5 | 1 | 20 | 200 | II |
| 21m | 2 | 11 | 5 | 3 | 4 | 1 | 25 | 200 | I |
| 21n | 2 | 11 | 6 | 2.5 | 3.5 | 1 | 29 | 200 | I |
| 21o | 4 | 11 | 5 | 3 | 4 | 1 | 25 | 200 | IV |
| 21p | 1.5 | 11 | 5 | 3 | 4 | 1 | 25 | 200 | I |

As shown in TABLE 3, the brush rollers 21*l*, 21*m*, 21*n*, and 21*p* had at least substantially the same oblique brush amounts (A) of 1 mm and the similar brush thicknesses (BT) of 2 deniers or below. The images formed by using the brush roller 21*m*, 21*n*, and 21*p* having the oblique brush ratios of 25% or above were evaluated as Class I while the image formed by using the brush roller 21*l* having the oblique brush ratio of 20% was evaluated as Class II. The higher the oblique brush ratio, the higher the centrifugal force. Therefore, when the brush roller 21*m*, 21*n*, and 21*p* were rerotated, the outside diameters thereof were considered to be increased by the higher centrifugal forces. Thereby, the images formed by using the brush roller 21*m*, 21*n*, and 21*p* were evaluated as Class I.

The brush rollers 21*m*, 21*o*, and 21*p* had the oblique brush ratios of 25% or above while each had a different brush thickness. As shown in TABLE 3, when the brush roller 21*o* having the brush thickness of 4 deniers was used, the image was evaluated as Class IV. On the other hand, when the brush rollers 21*m* and 21*p* having the brush thicknesses of 2 deniers or below were used, the images were evaluated as Class II. The lower the brush thickness, the softer the brush hairs. The softer brush hairs may be curled easily, and the curled brush hairs may easily expand the outside diameter thereof by the centrifugal force. Therefore, the brush hairs for each of the brush rollers 21*m* and 21*p* increased a tendency thereof to curl. However, when each of the brush roller 21*m* and 21*p* was rerotated after the one week, the brush hairs for each of the brush rollers 21*m* and 21*p* was considered to increase a tendency thereof to expand the outside diameter by the centrifugal force.

Still another example experiment (referred to as an example experiment 4) was conducted by using a plurality of the brush rollers 21 that were numbered in 21*q* through 21*u*. A detailed description of the example experiment 4 will be given.

The example experiment 4 was similar to the example experiment 1, except for, a brush material, a tensile strength (TS), and a brush hair shape. The brush material is a material that forms the brush for the brush roller 21. Each brush material has a different tensile strength. The properties, abbreviations, and evaluation Class used for the example experiment 4 were corresponding to those of the example experiment 1. Evaluation results of the example experiment 4 will be shown in TABLE 4.

TABLE 4

| # | Brush material | TS(kgf/cm$^2$) | Shape | EV |
|---|---|---|---|---|
| 21q | Nylon | 630 | Circular | II |
| 21r | Polypropylene (PP) | 330 | Circular | II |
| 21s | Acrylic | 760 | Circular | II |
| 21t | Polyethylene terephthalate (PET) | 860 | Circular | III |
| 21u | Nylon | 630 | Flat | I |

Figure 4:
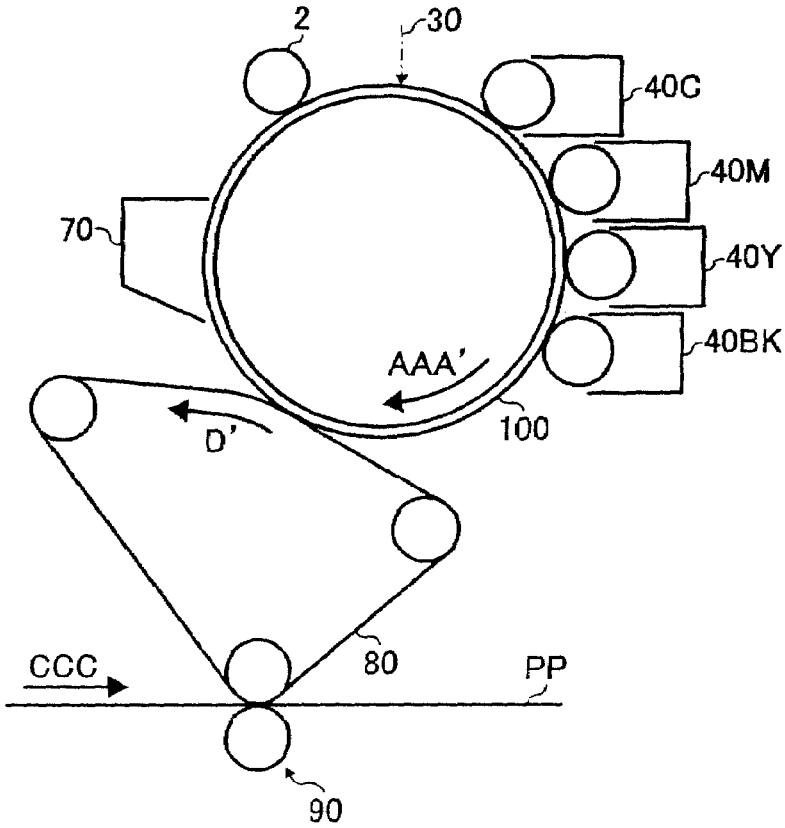
FIG. 4 is a schematic diagram partially illustrating a configuration of an image forming apparatus employing a single drum system.

As shown in FIG. 4, when the PET brush roller 21*t* having the tensile strength of 860 kgf/cm$^2$ was used, the image was evaluated as Class III.

When the tensile strength was 800 kgf/cm2 (78.4 MPa) or below, for example, the brush rollers 21*q*, 21*r*, 21*s* and 21*u*, the images were evaluated as Class III or better. For example, when a plurality of the brush rollers 21 formed by different brush materials have at least substantially the same brush thicknesses, a brush roller 21 with a lower tensile strength has softer brush hairs. The softer brush hairs may be curled easily, and the curled brush hairs may expand the outside diameter thereof easily by the centrifugal force. Thereby, the image may be evaluated as Class III or better.

As shown in TABLE 4, the brush roller 21*u* had flat brush hairs. The image formed by using the brush roller 21*u* was evaluated as Class I which was a better evaluation result than the images formed by using the brush rollers 21*q*, 21*r*, 21*s*, and 21*t* having circular brush hairs. The flat brush hairs may be extremely flexible with respect to a curvature in a direction towards a flat face thereof. Thereby, the flat brush hairs may be curled easily, and the curled brush hairs may expand the outside diameter thereof easily by the centrifugal force. Thereby, the image formed by using the brush roller 21*u* was evaluated as Class I.

Yet another example experiment (referred to as an example experiment 5) was conducted by using a plurality of the brush rollers 21 that were numbered 21*v*, 21*w*, 21*x*, 21*y*, 21*z*, 21*aa*, and 21*bb*. A detailed description of the example experiment 5 will be given.

The example experiment 5 was similar to the example experiment 2, except for, the use of an alternating current voltage. The alternating current voltage was applied to the plurality of the brush rollers 21*v*, 21*w*, 21*x*, 21*y*, 21*z*, 21*aa*, and 21*bb*. This alternating current voltage was provided by superimposing a rectangular-wave alternating current voltage having a peak-to-peak voltage Vpp of 1.0 kV, a duty of 40%, and a frequency of 300 Hz to a direct current voltage Vdc of −500 V. The properties, abbreviations, and evaluation Classes used for the example experiment 5 were corresponding to those of the example experiment 2. Evaluation results of the example experiment 5 will be shown in TABLE 5.

TABLE 5

| # | OD (MM) | SD (mm) | BL (mm) | PL (mm) | A (mm) | AR (%) | Z (rpm) | EV |
|---|---|---|---|---|---|---|---|---|
| 21v | 11 | 5 | 3 | 3 | 0 | 0 | 150 | IV |
| 21w | 11 | 5 | 3 | 3 | 0 | 0 | 200 | I |
| 21x | 11 | 5 | 3 | 3.5 | 0.5 | 14 | 200 | I |
| 21y | 11 | 5 | 3 | 4 | 1 | 25 | 150 | I |
| 21z | 11 | 5 | 3 | 4 | 1 | 25 | 100 | III |
| 21aa | 11 | 5 | 3 | 4.5 | 1.5 | 33 | 100 | I |
| 21bb | 11 | 5 | 3 | 5 | 2 | 40 | 100 | I |

As shown in FIG. 5, the evaluation results of the example experiment 5 were better than those of the example experiment 2. When the alternating current voltage was applied to each of the plurality of the brush rollers 21*v* through 21*bb*, an alternating electric field was formed between each of the brush rollers 21*v* through 21*bb* and the photoconductor surface. This electric field vibrated so that the contact state between each of the brush rollers 21*v* through 21*bb* and the photoconductor surface became a better state compared to a situation in which an electric field was formed by the direct current voltage shown in FIG. 2.

According to each of the example experiments 1, 2, 3, 4, and 5, each brush roller 21 was rotationally driven in the following direction with respect to the movement direction of the surface of the photoconductor 1 so that the evaluation result was provided based on the visual comparison of the image. However, when the brush roller 21 was rotationally driven in a counter-following direction with respect to the movement direction of the surface of the photoconductor 1, an evaluation result became at least substantially the same as the example experiments 1, 2, 3, 4, and 5.

According to each of the example experiments 1, 2, 3, 4, and 5, the photoconductor 1 had the process speed of 60 mm/s so that each experiment 1, 2, 3, 4, and 5 was conducted, and the evaluation result was provided. However, when the photoconductor 1 had the process speed between a range of 50 mm/s and 200 mm/s, an evaluation result became at least substantially the same as the example experiments 1, 2, 3, 4, and 5.

According to each of the example experiments 1, 2, 3, 4, and 5, the direct current voltage of −1.2 kV was applied to the brush roller 21 so that the each experiment 1, 2, 3, 4, and 5 was conducted, and the evaluation result was provided. However, when the direct current voltage between a range of −0.7 kV and −1.2 kV was applied, an evaluation result became at least substantially the same as the example experiments 1, 2, 3, 4, and 5.

According to each of the example experiments 1, 2, 3, 4, and 5, the brush roller 21 had the brush contact amount of 0.5 mm with respect to the surface of the photoconductor 1 so that the each experiment 1, 2, 3, 4, and 5 was conducted, and the evaluation result was provided. However, when the brush roller 21 had the brush contact amount of 1.0 mm or below, an evaluation result became at least substantially the same as the example experiments 1, 2, 3, 4, and 5.

According to the example experiment 5, the alternating current voltage was provided by superimposing the rectangular-wave alternating current voltage having the peak-to-peak voltage Vpp of 1.0 kV, the duty of 40%, and the frequency of 300 Hz to the direct current voltage Vdc of −500 V. However, when the alternating current voltage was provided by superimposing the rectangular-wave alternating current voltage having the peak-to-peak voltage Vpp between a range of 0.6 kV and 1.4 kV, the duty between a range of 25% and 85%, and the frequency between a range of 150 Hz and 500 Hz to the direct current voltage Vdc between a range of −300 V and −800 V, an evaluation result became at least substantially the same as that of the example experiments 5.

The exemplary embodiment of the image forming apparatus capable of forming the monochrome image is described above. However, the charging device 2 including the brush roller 21 of the exemplary embodiment of the present invention may be applied to an image forming apparatus capable of forming a plurality of colors with a tandem system and a single drum system, for example.

Figure 3:
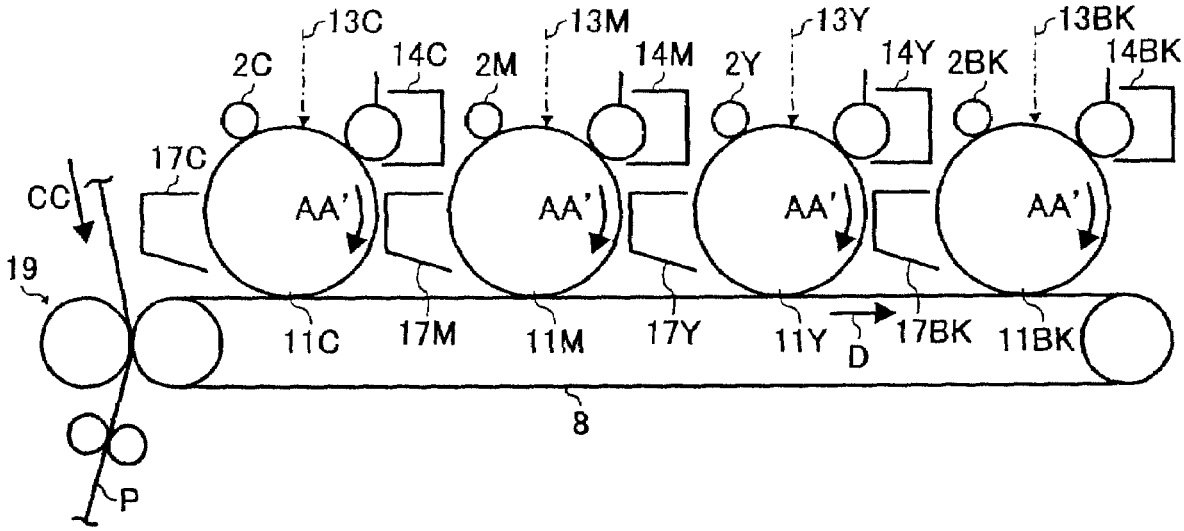
FIG. 3 is a schematic diagram partially illustrating a configuration of an image forming apparatus employing a tandem system.

Referring to FIG. 3, the image forming apparatus employing the tandem system is schematically illustrated. The image forming apparatus with the tandem system includes a plurality of image forming mechanisms.

As shown in FIG. 3, the image forming apparatus employing the tandem system includes an intermediate transfer belt 8, photoconductors 11C, 11M, 11Y, and 11BK. The photoconductors 11C includes a charging device 2C, a development device 14C, and a cleaning device 17C in a vicinity thereof. The photoconductor 11C forms the electrostatic latent image thereon by a laser beam 13C. The photoconductors 11M includes a charging device 2M, a development device 14M, and a cleaning device 17M in a vicinity thereof. The photoconductor 11M forms the electrostatic latent image thereon by a laser beam 13M. The photoconductors 11Y includes a charging device 2Y, a development device 14Y, and a cleaning device 17Y in a vicinity thereof. The photoconductor 11Y forms the electrostatic latent image thereon by a laser beam 13Y. The photoconductors 11BK includes a charging device 2BK, a development device 14BK, and a cleaning device 17BK in a vicinity thereof. The photoconductor 11BK forms the electrostatic latent image thereon by a laser beam 13BK. The charging devices 2C, 2M, 2Y, and 2BK include brush rollers 21C, 21M, 21Y, and 21BK (not shown), respectively. The reference symbols C, M, Y, and BK are abbreviations of cyan, magenta, yellow, and black colors, respectively, and these abbreviations may be omitted as necessary. The photoconductors 11, the development devices 14, the cleaning devices 17, and the laser beams 13 in FIG. 3 are similar to the photoconductor 1, the development device 4, the cleaning device 7, the laser beam 3 in FIG. 1, respectively, except for colors. The charging devices 2C, 2M, 2Y, and 2BK including the brush rollers 21C, 21M, 21Y, 21BK, respectively, are configured to be at least substantially the same as the charging device 2 including the brush roller 21 of the exemplary embodiment shown in FIG. 1 and FIG. 2, except for colors. Thereby, a detailed description of these image forming elements may be omitted.

The toner images are formed on the photoconductors 11C, 11M, 11Y, and 11BK in the image forming apparatus employing the tandem system. These toner images are primarily transferred onto the intermediate transfer belt 8 from the photoconductors 11C, 11M, 11Y, and 11BK in such a manner that each toner image is superimposed one on another. The intermediate transfer belt 8 moves in a direction D indicated by an arrow. When the toner images are superimposed one on another, a color image is formed on the intermediate transfer belt 8. This color image is secondarily transferred onto a transfer sheet P by a secondary transfer device 19. The transfer sheet P is conveyed on a sheet conveyance path CC. The transfer sheet P with the color image is fixed by a fixing device (not shown), and is ejected from the image forming apparatus.

The image forming apparatus with the tandem system employs the brush rollers 21C, 21M, 21Y, and 21BK that are at least substantially the same as the brush roller 21 in FIG. 2. When the brush rollers 21C, 21M, 21Y, and 21BK are left for a certain time period without rotating thereof while contacting on the photoconductor surfaces, the brush hairs for the brush rollers 21C, 21M, 21Y, and 21BK may become skewed and curled. However, when the brush rollers 21, 21M, 21Y, and 21BK are rerotated, the skewed and curled brush hairs may be restored by the resiliencies thereof and the centrifugal forces applied thereto. Thereby, the photoconductor surface may be charged appropriately by the brush rollers 21C, 21M, 21Y, and 21BK.

Referring to FIG. 4, the image forming apparatus employing the single drum system is schematically illustrated. The image forming apparatus with the single drum system includes an intermediate transfer belt 80 and a photoconductor 100. The photoconductor 100 includes a charging device 2, development devices 40C, 40M, 40Y, and 40BK, a cleaning device 70 in a vicinity thereof. The photoconductor 100 forms the electrostatic latent image thereon by a laser beam 30. The charging device 2 includes the brush roller 21 (not shown). The reference symbols C, M, Y, and BK are abbreviations of cyan, magenta, yellow, and black colors, respectively, and these abbreviations may be omitted as necessary. The photoconductors 100, the cleaning devices 70, and the laser beams 30 in FIG. 4 are similar to the photoconductor 1, the cleaning device 7, and the laser beam 3 in FIG. 1, respectively, except for colors. The development devices 40C, 40M, 40Y, and 40BK are similar to the development device 4 in FIG. 1, except for colors. The charging device 2 including the brush roller 21 is configured to be at least substantially the same as the charging device 2 including the brush roller 21 of the exemplary embodiment shown in FIG. 1 and FIG. 2. Thereby, a detailed description of these image forming elements may be omitted.

As shown in FIG. 4, the development devices 40C, 40M, 40Y, and 40BK are disposed with respect to the photoconductor 100. The photoconductor 100 sequentially forms the electrostatic latent images of four colors one after another thereon. The electrostatic static latent images are sequentially developed by respective development devices 40C, 40M, 40Y, and 40BK so that toner images of four colors are formed on the photoconductor 100. The toner images of four colors are primarily transferred onto the intermediate transfer belt 80 from the photoconductor 100 in such a manner that the toner images are superimposed one on another. When the toner images are superimposed one on another, the color image is formed on the intermediate transfer belt 80. The intermediate transfer belt 80 moves in a direction D' indicated by an arrow. This color image is secondarily transferred onto a transfer sheet PP by a secondary transfer device 90. The transfer sheet PP is conveyed on a sheet conveyance path CCC. The transfer sheet PP with the color image is fixed by a fixing device (not shown), and is ejected from the image forming apparatus.

The image forming apparatus with the single drum system employs the brush roller 21 that is at least substantially the same as the brush roller 21 in FIG. 1 and FIG. 2. When the brush roller 21 is left for a certain time period without rotating thereof while contacting on the photoconductor surfaces, the brush hairs for the brush roller 21 may become skewed and curled. However, when the brush roller 21 is rerotated, the skewed and curled brush hairs may be restored by the resiliency thereof and the centrifugal force applied thereto. Thereby, the photoconductor surface may be charged appropriately by the brush roller 21.

According to the image forming apparatuses capable of forming the monochrome image and the color image of the exemplary embodiment above, the surface of the photoconductor as the latent image carrier is uniformly charged by the charging device 2, and forms the electrostatic latent image thereon. The electrostatic latent image is developed with the toner to form the toner image. The toner image is eventually transferred onto the transfer sheet as the recording member. Each of the image forming apparatuses includes the charging device 2, a drive motor, and a power source. The charging device 2 has the brush roller 21. The brush roller 21 is configured to include the brush having the brush hairs with the thickness of 2 deniers or below, the tensile strength of 800 $kgf/cm^2$ (78.4 MPa) or below, and the pile length of 2.5 mm or above. The brush roller 21 is configured to include the brush having the large number of brush hairs on an outer circumference surface of the circular cylindrical shaft, and have the outside diameter of 12 mm or below. The brush roller 21 is rotationally driven by the drive motor, for example, the drive motor 22 in FIG. 2. The brush roller 21 receives the voltage applied by the power source, for example, the power source 23 in FIG. 2 as a voltage applying mechanism. The brush roller 21 is disposed in such a manner that the brush roller 21 is abutted on the photoconductor surface with a certain brush contact amount.

The brush roller 21 with the voltage uniformly charges the photoconductor surface during the charging process. When the charging device 2 has the oblique brush hair amount A (mm) in the brush thereof and the rotation number Z (rpm) during the charging process, the oblique brush hair amount A and the rotation number Z are arranged to satisfy the relationship, $Z>150-50A$. Therefore, when the brush roller 21 having the outside diameter of 12 mm or below is left for a certain time period without rotating thereof while contacting on the photoconductor surfaces, the brush hairs for the brush roller 21 may become skewed and curled. However, when the brush roller 21 is rerotated, the photoconductor surface may be charged appropriately by the brush roller 21. Therefore, each of the image forming apparatus may form a high quality image without the black belt even after the brush roller 21 is left for the certain time period.

According to the example experiment 4, when the brush roller 21 having the flat brush is used, an image may be evaluated more satisfactorily compared to a situation in which the brush roller 21 having the circular brush is used.

According to the example experiment 3, when the brush roller 21 has the oblique brush ratio of 20% or above, an image may be evaluated satisfactorily.

According to the example experiment 5, when the power source, for example the power source 23, applies the alternating current voltage, an image may be evaluated more satisfactorily compared to a situation in which the power source applies the direct current voltage.

The exemplary embodiments of the present invention described above are applied to the image forming apparatuses, for example, printers. However, the exemplary embodiments may be applied to another image forming apparatus, for example, a copier and a facsimile.

The exemplary embodiments of the present invention described above include the image forming apparatuses having a cleaning device, for example, the cleaning device 7 in FIG. 1. However, the exemplary embodiments of the present invention may be applied to an image forming apparatus having substantially no cleaning device (referred to as a cleanerless system). The image forming apparatus employing the cleanerless system collects the remaining toner by using the development device, for example. When the image forming apparatus employing the cleanerless system is used, the remaining toner on the photoconductor surface contacts a brush roller, and the remaining toner increases a tendency thereof to adhere to the brush roller. When the brush roller has the remaining toner adhered thereto, a resistance between the brush roller and the photoconductor may be increased. Thereby, the photoconductor surface in contact with a brush having a skewed and curled brush hairs may increase a tendency thereof to be charged inappropriately after the certain period time. Accordingly, when a brush roller, for example, the brush roller 21, is used for the image forming apparatus employing the cleanerless system, an occurrence of inappropriately charging the photoconductor surface may be reduced.

Numerous additional modifications and variations are possible in light of the above teachings. It is therefore to be understood that within the scope of the appended claims, the disclosure of this patent specification may be practiced otherwise than as specifically described herein.

What is claimed is:

1. A charging device for applying a voltage to a latent image carrier of an image forming apparatus, the charging device comprising:

a brush roller including a cylindrical shaft, and a brush having an oblique brush amount and disposed on an outer circumference surface of the cylindrical shaft, wherein the brush roller is disposed with respect to a surface of the latent image carrier in such a manner that the brush roller is abutted with a suitable brush contact amount, and is configured to uniformly charge the surface of the latent image carrier during a charging process;

a voltage applying mechanism configured to apply a charging voltage to the brush roller; and a driving mechanism configured to rotationally drive the brush roller at a predetermined rotation number so as to satisfy a relationship $Z>150-50A$, where Z is a value of a rotation number (rpm) of the brush roller, and A is a value of the oblique brush amount (mm), wherein the latent image carrier is rotated in a first direction and the brush roller is rotated in a second direction different from the first direction so that during rotation, the area of the brush roller abutted with the surface of the latent image carrier moves in a same movement direction as a movement direction of the surface of the latent image carrier, wherein the brush roller has an outside diameter of 12 mm or less.

2. The charging device of claim 1, wherein the brush includes a plurality of brush hairs, the plurality of brush hairs having a brush thickness of 2 deniers or below, a tensile strength of 78.4 MPa or below, and a brush length of 2.5 mm or above.

3. A charging device for applying a voltage to a latent image carrier of an image forming apparatus, the charging device comprising:

a brush roller including a cylindrical shaft, and a brush having an oblique brush amount and a plurality of flat brush hairs on an outer circumference surface of the cylindrical shaft, wherein the brush roller is disposed with respect to a surface of the latent image carrier in such a manner that the brush roller is abutted with a suitable brush contact amount, and configured to uniformly charge the surface of the latent image carrier during a charging process;

a voltage applying mechanism configured to apply a charging voltage to the brush roller; and a driving mechanism configured to rotationally drive the brush roller at a predetermined rotation number so as to satisfy a relationship $Z>150-50A$, where Z is a value of a rotation number (rpm) of the brush roller, and A is the oblique brush amount (mm), wherein the latent image carrier is rotated in a first direction and the brush roller is rotated in a second direction different from the first direction so that during rotation, the area of the brush roller abutted with the surface of the latent image carrier moves in a same movement direction as a movement direction of the surface of the latent image carrier, wherein the brush roller has an outside diameter of 12 mm or less.

4. The charging device of claim 3, wherein the plurality of flat brush hairs have a tensile strength of 78.4 MPa or below, and a brush length of 2.5 mm or above.

5. The charging device of claim 1, wherein the brush has an oblique brush ratio of at least 20%.

6. The charging device of claim 1, wherein the charging voltage applied by the voltage applying mechanism is an alternating current voltage.

7. An image forming apparatus including the charging device of claim 1 configured to form a toner image by uniformly charging the surface of the latent image carrier, forming a latent image on the surface of the latent image carrier, adhering a toner onto the latent image, and transferring the toner image onto a recording member.

8. A process cartridge including the charging device of claim 1 configured to be detachably installed in an image forming apparatus.

9. The process partridge of claim 8, wherein the latent image carrier and the brush roller included in the charging device are integrally supported by the process cartridge.

10. A method of applying a voltage with a brush roller to a latent image carrier of an image forming apparatus, the method comprising:

disposing a brush roller including a cylindrical shaft and a brush having an oblique brush amount in such a manner that the brush roller is abutted with a suitable brush contact amount to uniformly charge the surface of the latent image carrier during charging;

applying a charging voltage to the brush roller; and rotationally driving the brush roller at a predetermined rotation number so as to satisfy a relationship $Z>150-50A$, where Z is a value of a rotation number (rpm) of the brush roller, and A is a value of the oblique brush amount (mm), wherein the latent image carrier is rotated in a first direction and the brush roller is rotated in a second direction different from the first direction so that during rotation, the area of the brush roller abutted with the surface of the latent image carrier moves in a same movement direction as a movement direction of the surface of the latent image carrier, wherein the brush roller has an outside diameter of 12 mm or less.

* * * * *